US006860656B1

(12) United States Patent
Piccinino, Jr.

(10) Patent No.: US 6,860,656 B1
(45) Date of Patent: Mar. 1, 2005

(54) PHOTOGRAPHIC PROCESSING SYSTEM HAVING A VACUUM PLATEN

(75) Inventor: Ralph L. Piccinino, Jr., Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/714,008

(22) Filed: Nov. 14, 2003

(51) Int. Cl.[7] ..... G03D 5/00

(52) U.S. Cl. ..... 396/604; 396/612; 396/618; 355/27; 134/64 P; 134/122 P

(58) Field of Search ..... 396/604–609, 396/612, 618, 626, 636; 355/27–29, 40, 41, 77; 134/64 P, 64 R, 122 P, 122 R

(56) References Cited

U.S. PATENT DOCUMENTS 6,241,401 B1 * 6/2001 Sanada et al. ..... 396/604

6,382,850 B1 * 5/2002 Freund et al. ..... 400/118.2

* cited by examiner

*Primary Examiner*—D. Rutledge
(74) *Attorney, Agent, or Firm*—David A. Novais

(57) ABSTRACT

The present invention relates to a photographic processing system and a method of processing photographic media, wherein a conveying member having slots therein is provided on top of a vacuum chamber and is used to convey photographic media to be processed. A processing solution supply member applies processing solution onto the photographic media on the conveying member, and a vacuum air source is adapted to apply a vacuum suction force to the vacuum chamber to hold the sheet of photographic media flat either during the application of processing solution to the media or after the processing solution is applied to the media.

7 Claims, 4 Drawing Sheets

PHOTOGRAPHIC PROCESSING SYSTEM HAVING A VACUUM PLATEN

FIELD OF THE INVENTION

The present invention relates to a photographic processing system in which a vacuum platen is adapted to convey and hold photographic media during the processing of the media.

BACKGROUND OF THE INVENTION

Conventional photographic systems for processing photographic media generally process the media in processing tanks, wherein the media is conveyed through the tanks so as to be in contact with several distinct processing solutions. The conveyance of the media essentially utilizes conveying rollers which in most instances touch both the emulsion and non-emulsion side of the photographic media. Further, the utilization of conveying rollers in most instances does not assure that the photographic media is held flat during the processing cycle. These factors adversely affect the subsequent processing of the photographic media.

SUMMARY OF THE INVENTION

The present invention provides for a photographic processing system and a method of processing photographic media which utilizes a vacuum platen that is adapted to hold photographic media (such as a sheet) flat during processing, and is further adapted to transport the sheet without touching the emulsion side of the photographic media. The system of the present invention further permits photographic chemicals or solutions to be sprayed or applied onto the photographic media at the same time that vacuum pressure for holding the sheet flat is applied, without allowing these photographic chemicals to enter or get into a vacuum pump.

The present invention therefore relates to a photographic processing system that comprises a conveying member adapted to transport photographic media to be processed, with the conveying member comprising a plurality of slots, and the conveying member being provided on top of a vacuum chamber; a processing solution supply member adapted to supply processing solution onto photographic media on the conveying member to process the photographic media; and a vacuum air source adapted to apply a vacuum suction force to the vacuum chamber. The suction force passes through slots on the conveying member to hold photographic media on the conveying member flat.

The present invention further relates to a method of processing photographic media which comprises the steps of placing exposed photographic media on a surface of a conveying member, with the surface of the conveying member having a plurality of slots therein; applying a vacuum suction force through the slots to hold the photographic media flat on the surface of the conveying member; and supplying a processing solution onto the photographic media while the photographic media is being held on the conveying member by the suction force.

DETAILED DESCRIPTION OF THE INVENTION

Figure 1:
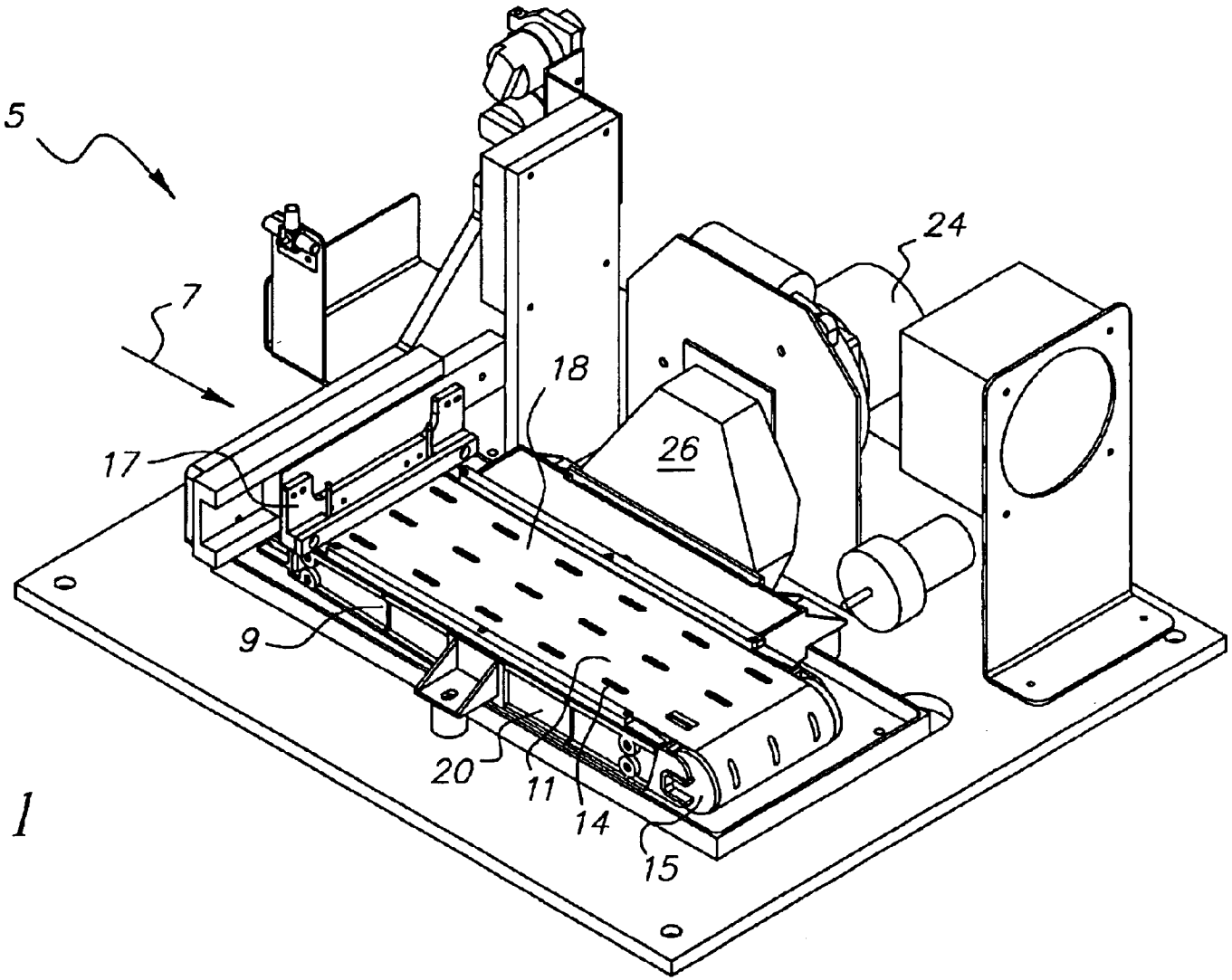
FIG. 1 is a view of a processing system including a vacuum platen in accordance with the present invention.
Figure 2:
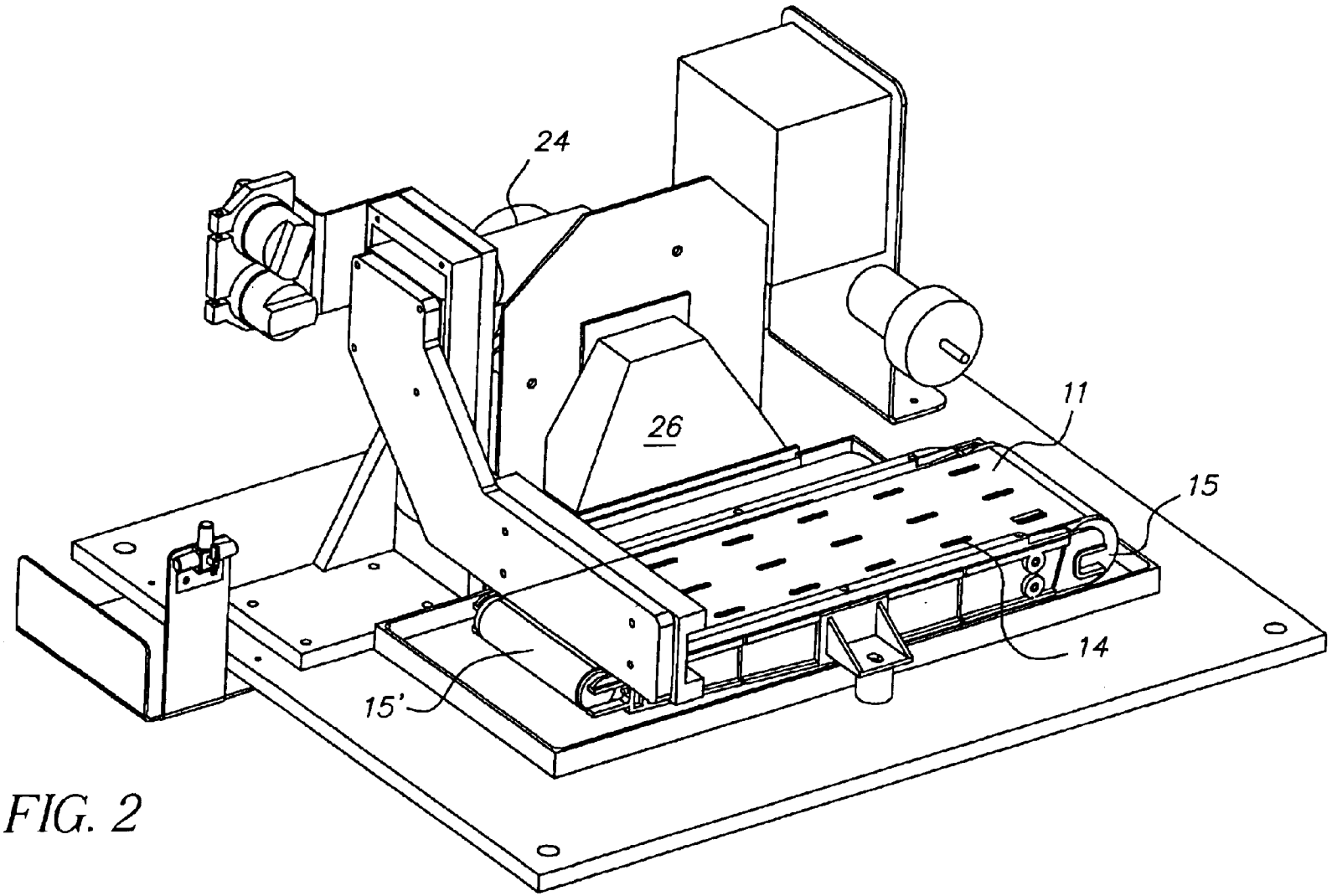
FIG. 2 is a further view of the processing system of FIG. 1.

Referring now to the drawings, wherein like reference numerals designate identical or corresponding parts throughout the several views, FIG. 1 is a schematic illustration of a photographic processing system 5 in accordance with the present invention. Photographic processing system 5 preferably makes up part of an overall photographic processing arrangement wherein a suitable transporting arrangement transports exposed photographic media in a direction represented by arrow 7 towards a conveying member 9. Conveying member 9 preferably comprises an endless belt 11 having a plurality of slots, holes or apertures 14 therein. Endless belt 11 is wrapped around rollers 15 and 15' as shown in FIG. 2.

Processing system 5 further includes a processing solution supply member 17 which has a plurality of discharge openings that face down onto a top surface 18 of belt 11. Processing solution supply member 17 preferably receives processing solution from a known solution supply source and is adapted to discharge or spray the processing solution onto photographic media on surface 18 of conveying belt 11, to permit a processing (such as an impingement processing) of the photographic media. Processing solutions utilized and supplied by solution supply member 17 are the solutions known in photographic processing to develop exposed images on photographic media, such as developer solution, bleach solution, fixed solution, etc.; or supply member 17 could be an ink cartridge adapted to apply a processing solution such as ink onto the media.

Therefore, in order to process and expose photographic media (preferably a photographic sheet) in accordance with the present invention, the sheet is supplied in the direction of arrow 7 onto processing system 5. The sheet is directed onto top surface 18 of endless belt 11 and passes between the discharge opening of processing solution supply member 17 and surface 18 of belt 11. As the sheet passes between processing solution supply member 17 and top surface 18, processing solution is sprayed and/or supplied onto the top surface of the photographic sheet to process or develop the exposed images on the sheet.

Figure 3:
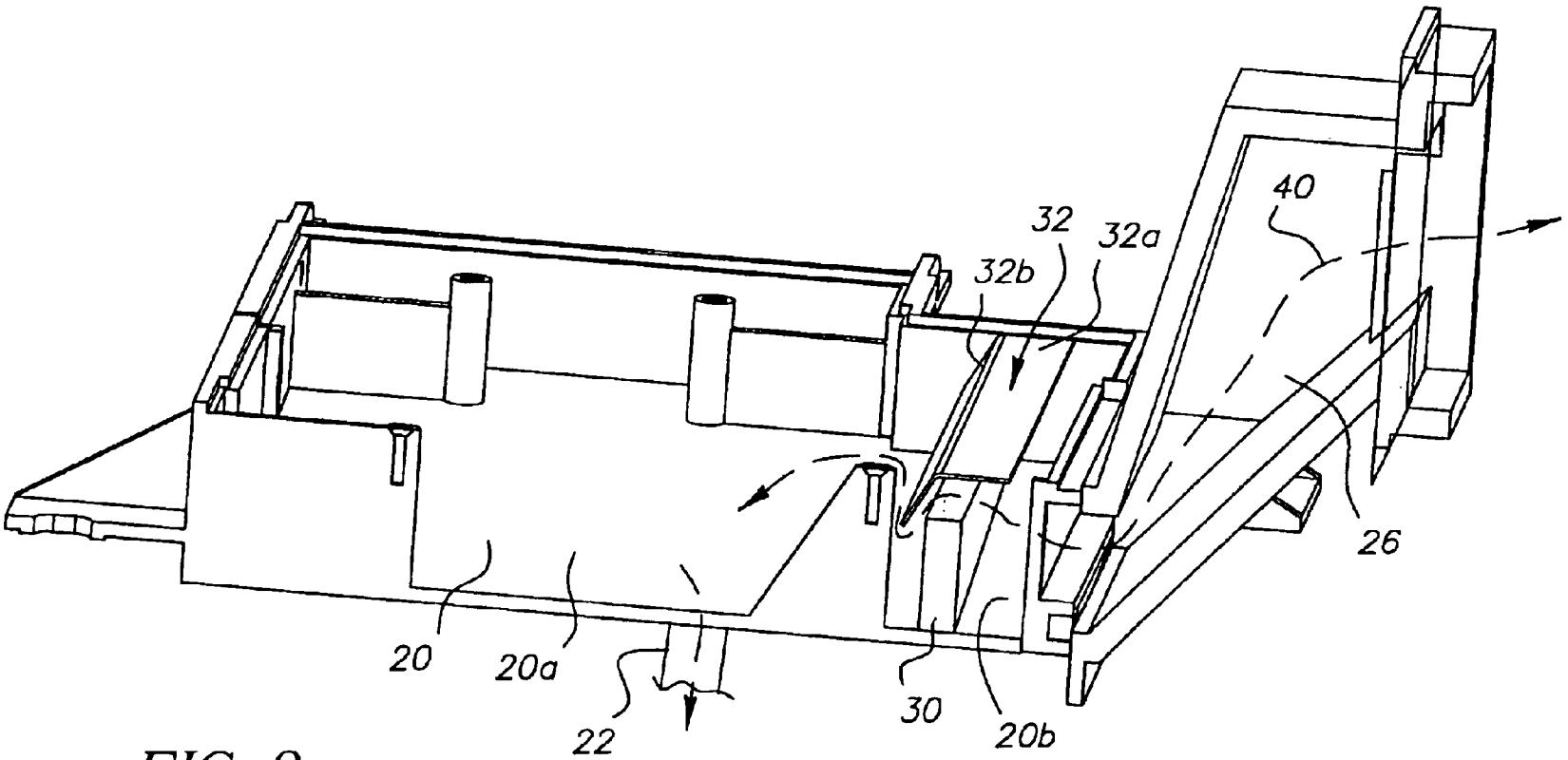
FIG. 3 is a view of a vacuum chamber and suction air path of the processing system of the present invention.

In a feature of the present invention, belt 11 of conveying member 9 includes slots 14 as described above. Therefore, as the solution is sprayed onto the photographic sheet, excess solution which drips off the sheet will fall through slots 14 into a vacuum chamber 20 located below top surface 18 of belt 11. The interior of chamber 20 is illustrated in FIG. 3. Chamber 20 is preferably designed to receive all excess solution which drips through slots 14 and appropriately drain the solution through a discharge line 22 to an appropriate drain site or to a site to be recycled.

In a further feature of the present invention, during processing of the photographic sheet, it is preferable that the photographic sheet be held in a flat state. With the arrangement of the present invention, a vacuum source in the form of, for example, a vacuum pump 24 is adapted to apply a suction force through a suction path 26 as shown in FIGS. 1–3. This arrangement provides the advantage of transporting photographic sheets emulsion side up in a manner in which the emulsion side is not contacted and the non-emulsion side contacts the top surface 18 of belt 11. Further, the sheet is held flat during processing by the suction force applied by vacuum pump 24 through chamber 26 and slots 14. Thus, the suction force can be applied while the solution is being supplied to the media or after the solution is supplied to the media.

With the arrangement of the present invention, photographic processing solution supplied from supply member 17 will leak down through slots 14 into chamber 20. This raises the possibility of the solution entering suction path 26 and vacuum pump 24 which could adversely affect the operation of pump 24. This is prevented by a further feature of the invention which includes a wall 30 and a baffle 32 as shown in FIG. 3. Wall 30 generally divides vacuum chamber 20 into a first section 20*a* which is essentially located below belt 11, and a second section 20*b* which is closer to vacuum pump 24 than first section 20*a*. Baffle 32 is located generally above wall 30 and mounted on a wall of chamber 20. The combination of wall 30 and baffle 32 serves the dual purpose of (1) permitting the application of suction force from vacuum pump 24 and path 26 through slots 14 to hold photographic sheets flat during processing; and (2) preventing any processing solution which falls into first part 20*a* of vacuum chamber 20 from reaching path 26 and vacuum pump 24. Thus, with the arrangement of the present invention, the path of the suction air force is generally described by reference 40, and as shown, the suction force travels over the top surface of wall 30, between baffle 32 and wall 30, and extends between vacuum pump 24 and chamber 20*a*, to apply a suction force through slots 14 of belt 11.

Therefore, the combination of wall 30 and baffle 32 prevent processing solution from splashing throughout the processing system, maintains the solution within chamber 20*a* for drainage to drain 22, and prevents solution from reaching suction path 26 and contacting vacuum pump 24. That is, as shown in FIG. 3, baffle 32 preferably includes a generally flat or horizontal section 32*a* that extends above a top surface of wall 30 and an inclined section 32*b* which is inclined in a direction towards first part 20*a* of vacuum chamber 20. This provides for the guidance of the suction force from vacuum pump 24 and in addition, helps maintain the processing solution within the confines of part 20*a* of chamber 20.

Figure 4:
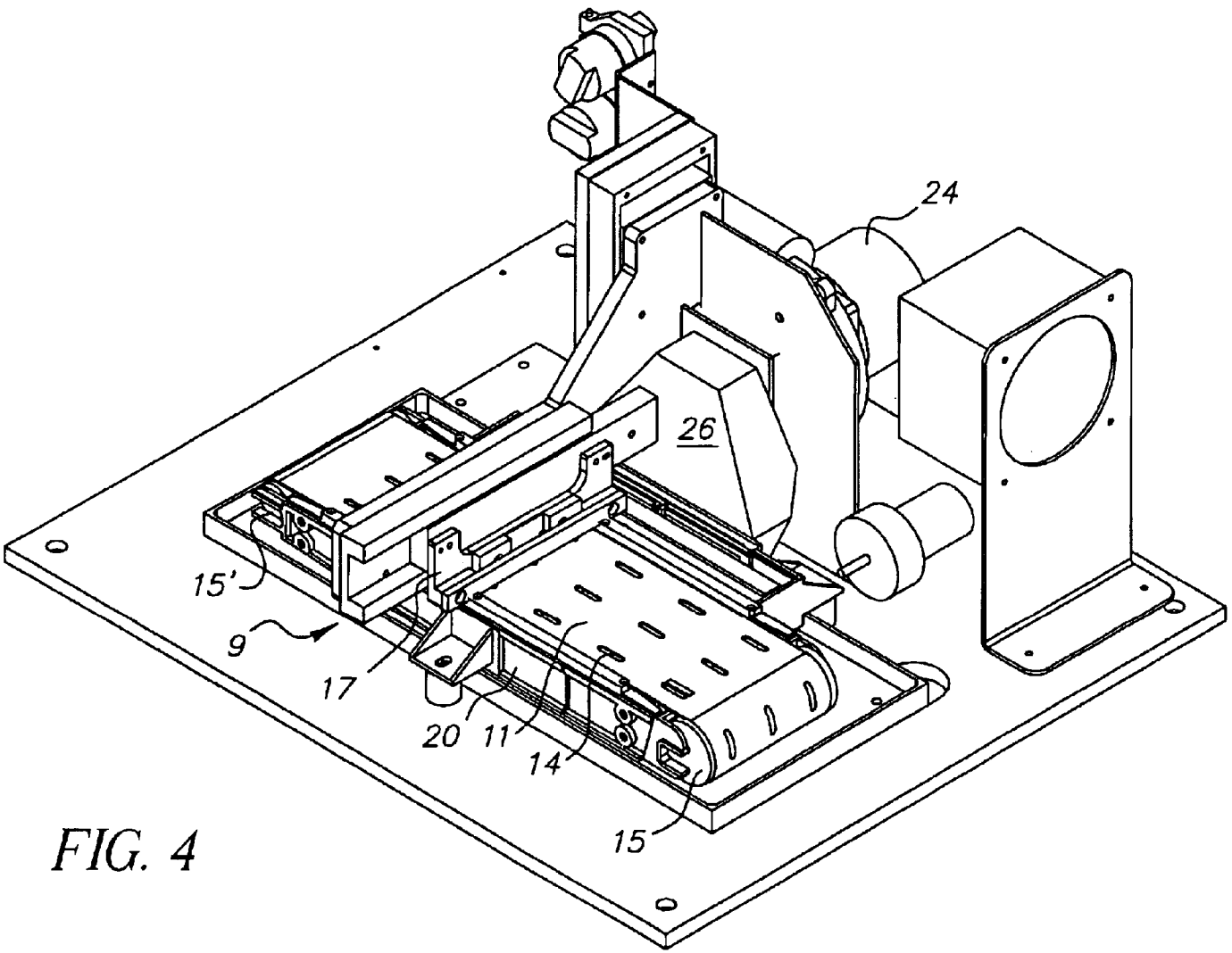
FIG. 4 is a view of a further embodiment of the processing system.

As shown in FIG. 1, the processing solution can be applied in a vicinity of the entrance of processing system 5 such that the conveyance of the sheet from this point provides a dwell time that is sufficient to allow development of the image(s) on the sheet. As a further option, the processing solution can be supplied from an area in the vicinity of the center of conveying member 9 as shown in FIG. 4 by locating solution supply member 17 in the vicinity of the center of conveying member 9. In this situation, conveying member 9 can be extended downstream from supply member 17 to allow for a longer dwell time, or the length can remain unchanged from the previous embodiment with the sheet being held in one spot until the appropriate amount of development time has occurred.

The invention has been described in detail with particular reference to certain preferred embodiments thereof, but it will be understood that variations and modifications can be effected within the spirit and scope of the invention.

What is claimed is:

1. A photographic processing system comprising:

a conveying member adapted to transport photographic media to be processed, said conveying member comprising a plurality of slots, said conveying member being provided on top of a vacuum chamber;

a processing solution supply member adapted to apply a processing solution onto photographic media on said conveying member to process said photographic media; and a vacuum air source adapted to apply a vacuum suction force to said vacuum chamber, such that said suction force passes through said slots on said conveying member to hold photographic media on said conveying member flat;

wherein said vacuum chamber comprises:

a wall that separates said chamber into a first section located below the conveying member which receives the processing solution from said processing solution supply member that passes through said slots, and a second section located closer to said vacuum air source than said first section, said vacuum chamber further comprising a baffle located above said wall;

said wall and said baffle permitting suction air from said vacuum air source to pass between said slots and said vacuum air source and preventing processing solution which passes through said slots into said chamber from entering into said second section and contacting said vacuum air source.

2. A system according to claim 1, wherein said baffle comprises a first part which is spaced from a top surface of said wall, and a second part which extends from said first part in a direction toward said first section of said vacuum chamber at a downward incline.

3. A system according to claim 1, wherein said vacuum air source comprises a vacuum air pump.

4. A system according to claim 1, wherein said conveying member comprises an endless conveying belt which passes around a pair of rollers, and a surface of said conveying belt comprises said slots.

5. A system according to claim 1, wherein said photographic media is cut sheets.

6. A photographic processing system comprising:

a conveying member adapted to transport photographic media to be processed, said conveying member comprising a plurality of slots, said conveying member being provided on top of a vacuum chamber;

a processing solution supply member adapted to apply a processing solution onto photographic media on said conveying member to process said photographic media; and a vacuum air source adapted to apply a vacuum suction force to said vacuum chamber, such that said suction force passes through said slots on said conveying member to hold photographic media on said conveying member flat;

wherein said vacuum chamber comprises a drain for draining processing solution from said vacuum chamber.

7. A method of processing photographic media, the method comprising the steps of:

placing an exposed photographic media on a surface of a conveying member, the surface of the conveying member having a plurality of slots therein;

applying a vacuum suction force through said slots to hold the photographic media on said surface of the conveying member;

supplying a processing solution onto said photographic media while the photographic media is being held on said conveying member by said suction force; and locating a wall and baffle arrangement in a path of said vacuum suction force which permits the suction force to pass between said slots and a source for said vacuum suction force, and prevents processing solution which passes through said slots from reaching said source.

* * * * *